United States Patent [19]

Pauly

[11] 4,187,636

[45] Feb. 12, 1980

[54] CAMPING TRAILER

[75] Inventor: Ronald R. Pauly, Mound, Minn.

[73] Assignee: Tonka Corporation, Spring Park, Minn.

[21] Appl. No.: 831,861

[22] Filed: Sep. 9, 1977

[51] Int. Cl.[2] ..... A63H 11/10

[52] U.S. Cl. ..... 46/201; 296/173

[58] Field of Search ..... 46/201, 202, 11, 17; 296/23 R, 23 H, 23 E, 23 F, 23 G

[56] References Cited

U.S. PATENT DOCUMENTS

| | | | |
|---|---|---|---|
| 1,690,178 | 11/1928 | Reeves | 46/11 |
| 2,225,993 | 12/1940 | Hornberger | 296/23 R |
| 2,259,783 | 10/1941 | Sparling | 296/23 R |
| 3,001,813 | 9/1961 | Johnson | 296/23 R |
| 3,357,031 | 12/1967 | Edwards | 296/23 R |
| 3,888,040 | 6/1975 | Waterhouse | 46/201 |

FOREIGN PATENT DOCUMENTS

| | | | |
|---|---|---|---|
| 1146723 | 11/1957 | France | 296/23 F |

*Primary Examiner*—Russell R. Kinsey
*Assistant Examiner*—Mickey Yu
*Attorney, Agent, or Firm*—Norman P. Friederichs

[57] ABSTRACT

The toy camping trailer includes a trailer box supported on a pair of wheels. The trailer has a two-piece pivotal top which may be collapsed to a travel position or raised to a camping use position. One top piece may include an open zone to permit access to the interior of the trailer while in the camping use position.

4 Claims, 5 Drawing Figures

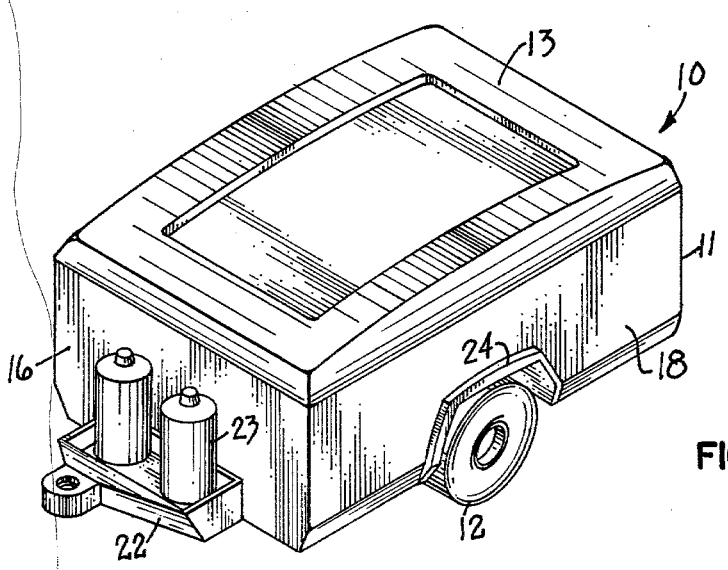
FIG. I
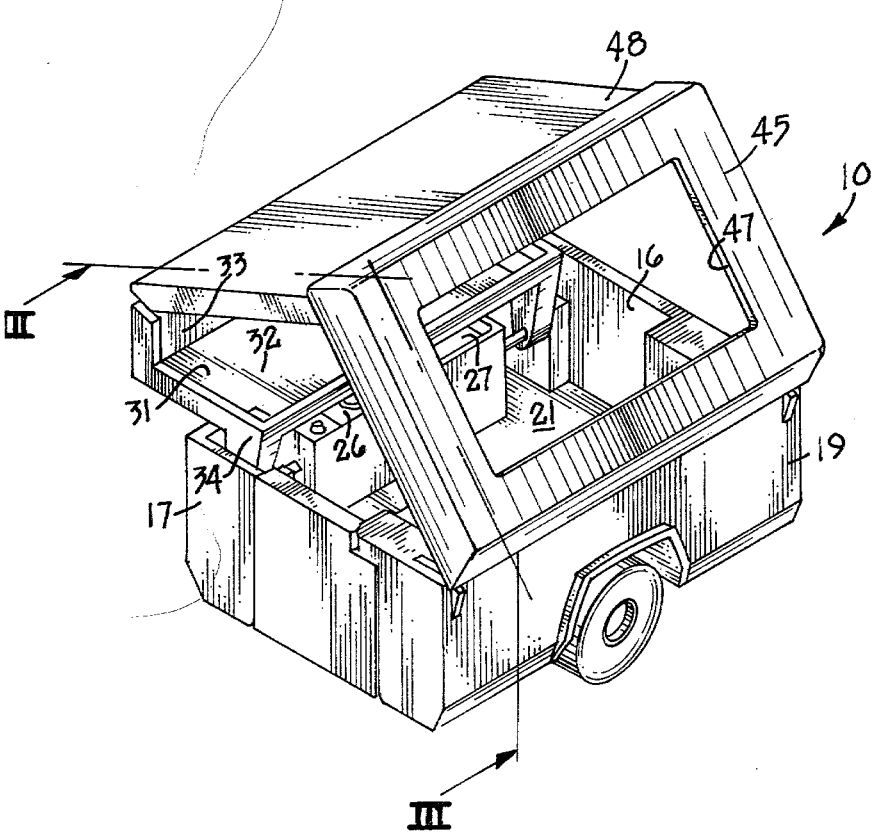
FIG. II

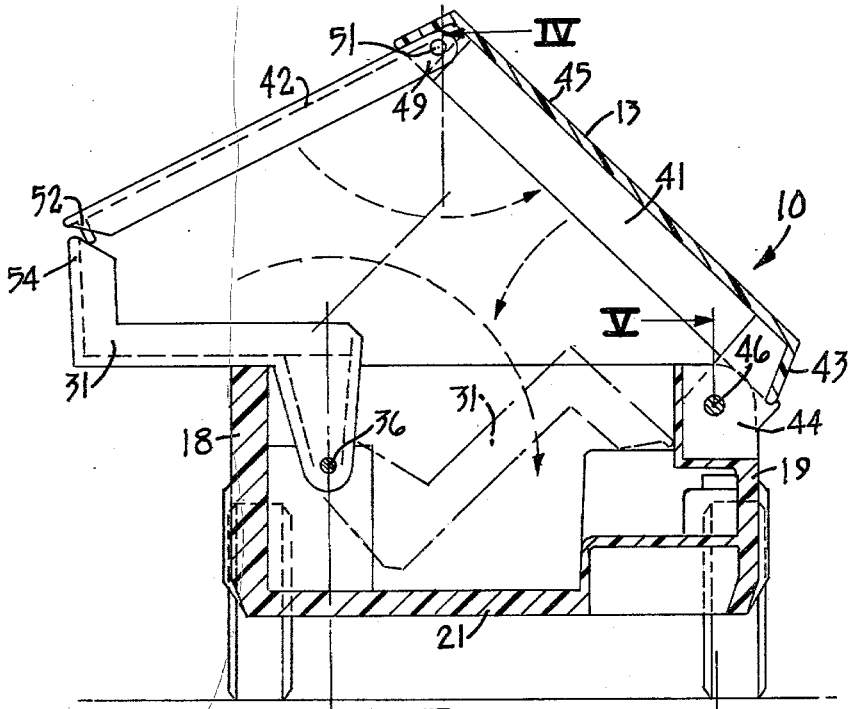
FIG. III
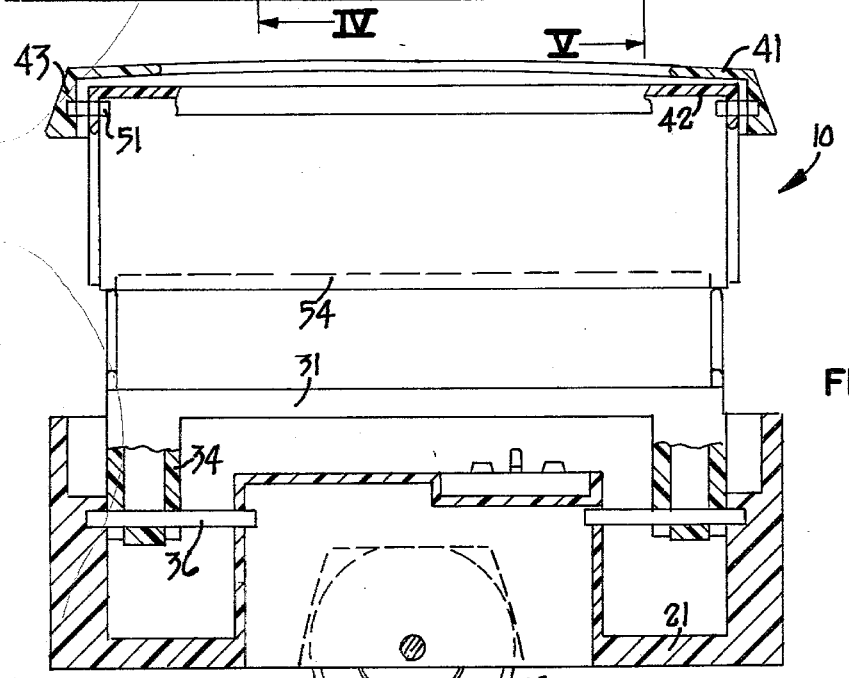
FIG. IV
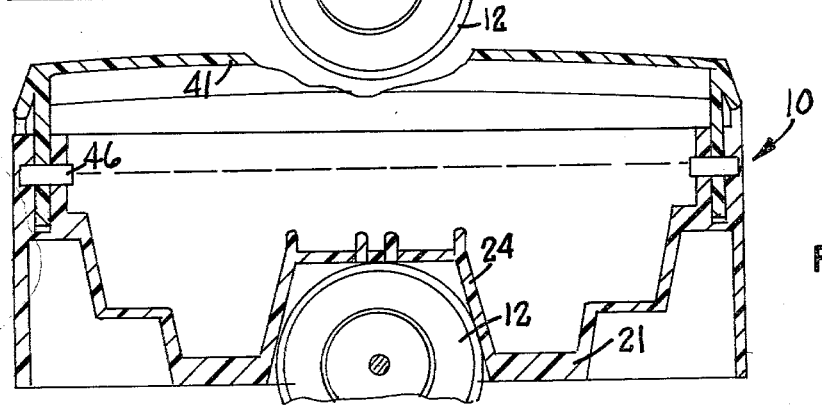
FIG. V

CAMPING TRAILER

BACKGROUND OF THE INVENTION

The present invention relates to toy vehicles and more particularly to toy camping trailers.

A wide variety of toy vehicles have been provided in the past and many of such toy vehicles have included a trailer of one type or another. For example, for many years toy farm tractors have been on the market together with toy farm trailers such as the type simulating a hay rack. Another type of vehicle combination including a trailer has been the semitractor-trailer combination. Also, toy automobiles towing small toy trailers have been readily available. In many instances the trailers have been provided with auxiliary items such as farm animals, soda pop cartons and the like. Such auxiliary equipment improves the play value and imaginative play for the child.

The present invention relates to a toy camping trailer which is adapted for positioning in a travel condition and change to a position closely resembling a camping set-up arrangement. The trailer may include the box having front and rear wall portions and a pair of side wall portions. The box also may include a floor or trailer bottom. The trailer box is supported by a pair of wheels which may be mounted on an axle. The wheels desirably are rotatable. The trailer further includes a top having a first top portion pivotally mounted to the box and a second top portion which is pivotally mounted to the first top portion. The first top portion is substantially the size of the upper side of the box and when in the travel position desirably covers the upper portion of the box. The second top member may be slightly smaller than the first member. The second top member may be pivoted to lie closely adjacent the first top member when in the collapsed position and may be pivoted away from the first member to rest upon the opposite side of the box when in the camping position. The trailer may include a pivotally mounted bed suitable for positioning within the trailer box or pivoted to a use position extending outwardly from the side of the box. When such a bed member is present the second top member may be supported on the bed member when in the camping use arrangement. The present camping trailer may be even more completely understood by consideration of the drawings together with the written description of the present invention.

IN THE DRAWINGS

FIG. I shows a perspective view of the present trailer in the travel position;

FIG. II shows the present toy camping trailer in the camping position;

FIG. III shows a cross-sectional view of the trailer taken along the line III—III in FIG. II.

FIG. IV is a cross-sectional view taken along the line IV—IV in FIG. III; and

FIG. V is a cross-sectional view taken along the line V—V in FIG. III.

DETAILED DESCRIPTION OF THE PRESENT INVENTION

The toy camping trailer 10 (FIGS. I—V) of the present invention may include a box 11, a pair of wheels 12 and a top 13. Box 11 may be molded of plastic material and includes front and rear portions 16, 17 and side portions 18, 19. The box 11 may further include a bottom or floor 21. The box 11 may be provided with a tongue 22 for attachment to a toy vehicle. The tongue 22 may have a small platform on which simulated propane gas tanks may be mounted. The tongue 22 and tanks 23 may be molded integral with box 11. The box 11 may have suitable wheel wells 24 molded into the side walls 18 and 19. The interior of box 11 may include various appliances and equipment such as a stove 26, a sink 27 as well as various other camping items such as a table. These facilities may be molded as part of the box 11. The lower side of the box 11 has provision for attachment or mounting of the axle on which wheels 12 are supported. Such attachment may be of the conventional nature and therefore is not disclosed in detail herein.

The trailer 10 has a bed 31 pivotally mounted adjacent side wall 18. The bed 31 includes a horizontal portion 32 which may extend substantially the inside length of the trailer box 11 and a vertical portion 33 extending upwardly from the outer edge of portion 32. The bed 31 has a pair of downwardly extending arms such as 34 which may be mounted to the front and rear wall portions 16 and 17 of box 11 such as by a pin 36. The bed 31 is adapted for pivoting to the position shown in FIGS. II and III when in the camping position or pivoted into the interior of the trailer 10 with vertical portion 33 approaching or resting upon the floor 21 when in the traveling position.

The trailer 10 has a top 13 which includes two portions or top members 41 and 42. The top member 41 has an upper planar portion 45 with a plurality of downwardly extending flange portions 43 around its periphery. The member 41 has a pair of downwardly extending arms such as 44, one of such arms being associated with the rear wall 17 of box 11 and the other being associated with the front wall 16. In other words, the arms 44 may be pivotally mounted to such walls by a pin 46. Upward pivoting of member 41 may be limited by contact of the arms 44 with the side wall 19. The member 41 may further include an open zone 47 suitable for providing access to the interior of the trailer during play.

The top member 42 may include a planar portion 48 which is slightly smaller in dimensions than the member 41 such that member 42 may be pivoted to lie immediately adjacent the planar portion 45. The member 42 has an arm portion 49 with pins 51 for pivotal mounting to the member 41. For example, the pin may extend between arms 49 and the end flanges 43 of member 41. The member 42 has a downwardly extending flange 52 which is spaced inwardly from the outer edge 53 of member 42 as shown in FIG. III. The flange 52 is adapted to trap the upper edge 54 of bed 31 thereby providing support for the top 13 when in the camping use position shown in FIG. III.

OPERATION OF THE PRESENT TOY TRAILER

Although operation of the present toy trailer would be apparent from the preceding description it will be further described hereinafter to provide an even more complete understanding of the present invention. The trailer 10 will typically be stored in the position shown in FIG. I which is the traveling position for the trailer. The trailer 10 may be suitably attached to a toy passenger vehicle. In play, the child may move the top portion 13 to a camping use position as shown in FIG. II. In other words, member 41 is pivoted upwardly on pin 46 and member 42 is pivoted outwardly away from member 41. Likewise, bed 31 is pivoted from the storage position adjacent floor 21 to the camping use position. Member 42 is then supported on the upper edge 54 of bed 31 in the manner illustrated in FIG. II. The child has access to the interior of the trailer through the opening 47 and may position toy figures within the trailer laying such figures on the bed 31 or standing the figures on the floor 21. Subsequently, the figures may be removed and the trailer 10 may be returned to the travel position by slightly raising the top portion 13 to permit pivoting of member 42 to a position immediately adjacent member 41 and at the same time pivoting bed 31 to lie within the inner portion of the box 11.

Various modifications may be made in the present invention without departing from the broader scope of the present invention. For example, the trailer 10 may be provided without the bed portion 31, in which case, member 42 would be supported upon side wall 18 with flange 52 resting thereagainst. Also, if desired, the open portion 47 may be provided in member 42 rather than member 41.

What is claimed is:

1. A toy camping trailer including a pair of wheels rotatably mounted on an axle, a box supported on said axle, a top means associated with said box, said top means including a first member and a second member, said first member being pivotably mounted along one edge to said box, and including a play access opening through which a child may insert and remove toy figures, said second member being pivotably mounted to the opposite side edge of said first member, said second member being pivotable from a first position aligned with said first member to a second position supported adjacent the opposite edge of said box, said second member serving to close said play access opening when in said aligned position.

2. The toy camping trailer of claim 1 wherein said second member includes a support flange along said support edge for support engagement with the opposite edge of said box.

3. The toy camping trailer of claim 1 wherein said trailer further includes pivotably mounted bed means, said bed means being pivotal between a storage position within said box to a use position extending outwardly from the side of said box.

4. The toy camping trailer of claim 3 wherein said second member is adapted for support along one edge of said bed means.

* * * * *